United States Patent [19]

Sidman et al.

[11] 4,433,439

[45] Feb. 28, 1984

[54] HEAT RESISTANT PROTECTIVE HAND COVERING

[75] Inventors: Kenneth R. Sidman, Wayland; Irving J. Arons, Peabody, all of Mass.

[73] Assignees: The United States of America as represented by the Administrator of the National Aeronautics and Space Administration, Washington, D.C.; Richard P. Tschirch, Westwood

[21] Appl. No.: 393,581

[22] Filed: Jun. 30, 1982

[51] Int. Cl.[3] ..... A41D 19/00

[52] U.S. Cl. ..... 2/161 R; 2/167

[58] Field of Search ..... 2/158, 159, 161 R, 167, 2/168

[56] References Cited

U.S. PATENT DOCUMENTS

| | | | |
|---|---|---|---|
| 1,730,763 | 10/1929 | Gerding | 2/158 X |
| 2,650,365 | 9/1953 | Singer | 2/161 R |
| 2,988,457 | 6/1961 | Catcomb | 2/167 X |
| 4,004,295 | 1/1977 | Byrnes | 2/161 R |
| 4,214,321 | 7/1980 | Nuwayser | 2/161 R |
| 4,302,851 | 12/1981 | Adair | 2/167 X |

*Primary Examiner*—Louis Rimrodt

*Attorney, Agent, or Firm*—Edward K. Fein; John R. Manning; Marvin F. Matthews

[57] ABSTRACT

A heat-resistant protective glove having first and second shells which generally define the palm side and backside of the glove, respectively, each of the shell sections being made of a temperature-resistant aromatic polyamide fiber, the first shell section being a twill weave, the second shell section being a knitted fabric, a first liner section having a flame-resistant, elastomeric coating on a surface contiguous the inner surface of the first shell section, and a second liner section inwardly of the second shell section, the first and second liner sections generally conforming to the configuration of the first and second shell sections, respectively, both of the first and second liner sections being comprised of a felt fabric of a temperature-resistant aromatic polyamide fiber.

11 Claims, 2 Drawing Figures

HEAT RESISTANT PROTECTIVE HAND COVERING

Origin of the Invention

The invention described herein was made in the performance of work under a NASA contract and is subject to the provisions of Section 305 of the National Aeronautics and Space Act of 1958, Public Law 85-568 (72 Stat 435, 42 U.S.C. 2457).

BACKGROUND OF THE INVENTION

1. Field of the Invention

The present invention relates to protective hand coverings such as gloves, mitts and the like and, more particularly, to gloves that provide improved levels of protection against cutting, puncturing or burning of the hands of the wearer.

Fireman, foundry workers, workers who work around furnaces or similar industrial installation are necessarily exposed to handling hot objects or direct exposure to flame or a high degree of heat which can quickly cause severe burns. In particular, fire fighters are continually exposed to a variety of hazards capable of causing substantial injury. Cuts, lacerations, and punctures result from contacts with broken glass, sharp metal and plastic objects, nail and wood splinters encountered in nearly all structural fires. Burns, whether from radiant thermal energy, hot objects or open flame, can occur in any fire. In addition, fire fighters can be exposed to electricity and hazardous liquids while fighting structural fires. All of these hazards are often obscured by poor lighting or smoke and, therefore, become even more dangerous.

Hazardous conditions are compounded by debris, soot, and water or other extinguishing agents that normally cover and permeate everything at and adjacent to a fire scene, including the fire fighters. Consequently, discomfort can be severe, adding to both fire fighter's stress and reduced alertness. These conditions contribute to fire fighters' susceptibility to injury by fire-scene hazards.

Accordingly, suitable protective garments, including gloves, are absolutely necessary to protect the fire fighter from severe injury in the performance of his duty. Such gloves must be fire and heat-resistant, resistant to cuts and punctures and not adversely affect comfort and dexterity.

2. Description of the Prior Art

The prior art, as exemplified by U.S. Pat. Nos. 1,730,763, 2,304,137, 2,650,365, 3,883,898, 4,004,295 and 4,302,851 all disclose various types of heat, flame and/or cut and puncture resistant gloves made of various materials.

U.S. Pat. No. 1,730,763 to Gerding discloses a protective glove for use against fire comprising an outer layer of woven or knitted asbestos fabric and an inner layer made of various materials such as cotton, wool, leather or any woven or knitted fabric having more cohesiveness or tensile strength than asbestos.

U.S. Pat. No. 2,304,137 to Peakes discloses a protective glove comprising an inner glove which is made of a layer of cotton fabric, balloon cloth or the like, coated with a viscous rubber layer, the inner glove being inserted into an outer wear resistant glove of any suitable type such as cotton fabric.

U.S. Pat. No. 4,302,851 to Adair discloses a high temperature protective mitt or glove of which the main outer layer is made of woven Kevlar fibers, the main outer layer also having a lining made of a layer of wool knit fabric.

While the prior art discussed above has, to some extent, overcome some of the difficulties in providing effective, protective hand apparel for fire fighters and the like, the need to constantly improve such apparel is readily apparent.

SUMMARY OF THE INVENTION

It is therfore an object of the present invention to provide protective hand apparel such as mitts or gloves which are heat and flame-resistant and which are resistant to cutting and puncturing.

Another object of the present invention is to provide protective hand apparel made of composite fabrics to maximize comfort and dexterity to the wearer while providing protection against heat, flame, cuts and punctures.

The above and other objects of the present invention will become apparent from the drawings, the description given herein and the appended claims.

The heat resistant, protective glove of the present invention is made up of first and second shell sections which define a palm side and a backside, respectively, of the glove, the first shell section being made of a twill weave fabric of a temperature-resistant aromatic polyamide fiber, the second shell section being made of a knitted fabric of a temperature-resistant aromatic polyamide fiber. The first and second shell sections are secured to one another, e.g. by sewing, to provide the desired glove configuration and an opening for insertion of the wearer's hand. The protective glove also includes a first liner section which is secured to and overlies the inner surface of the first shell section, the first liner section being comprised of a felt fabric of a temperature-resistant aromatic polyamide fiber and having a flame resistant, elastomeric coating on the surface facing and overlying the inner surface of first shell section. There is also provided a second liner section inwardly of the second shell section and generally overlying the inner surface of the second shell section, the second liner section comprising a felt fabric of a temperature resistant aromatic polyamide fiber. The first and second liner sections are secured and generally conform to the configuration of the first and second shell sections, respectively, to form the glove. Optionally, but preferably, the glove is provided with a generally tubular wristlet of a knitted fabric of a temperature-resistant aromatic polyamide fiber, one end of the wristlet being secured to the first and second shell sections in generally encircling relationship to the opening for insertion of the wearer's hand.

DESCRIPTION OF THE PREFERRED EMBODIMENT

The term "glove," as used herein, is intended to mean a conventional glove, a mitt, a mitten or any similar type wearing apparel for the hand. Thus, the present invention is directed not only to gloves provided with individual fingerstalls and a thumbstall but also hand apparel of the type wherein there are no individual fingerstalls but a thumbstall or where there are neither individual fingerstalls nor a thumbstall.

Figure 1:
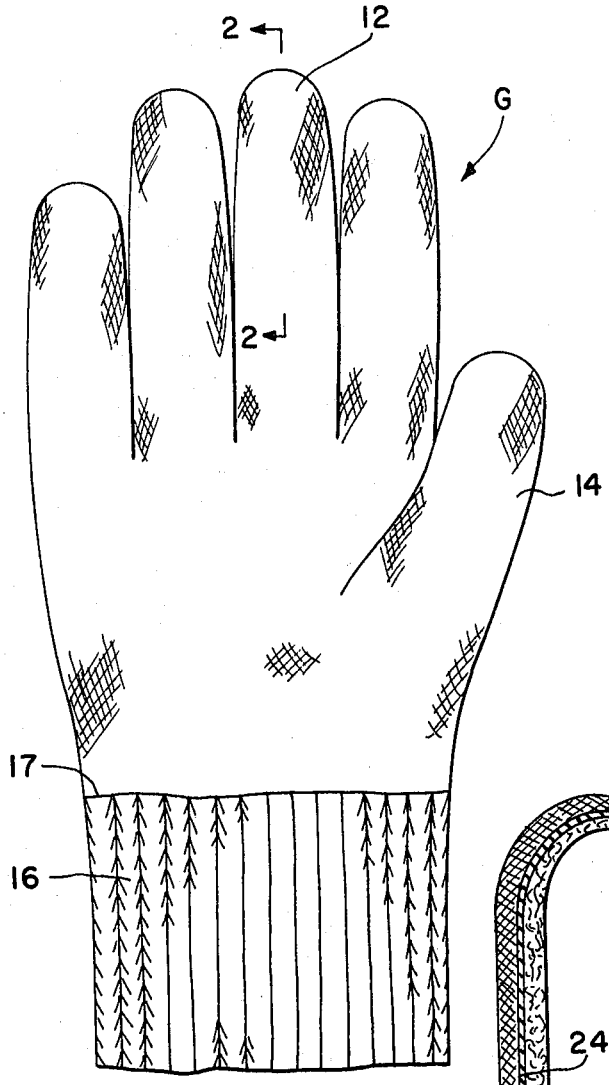
FIG. 1 is a front, elevational view of a protective glove constructed in accordance with the present invention.

Referring first to FIG. 1, the glove G is seen to have the usual fingerstalls 12, a thumbstall 14 and wrist cuff or wristlet 16. FIG. 1 shows the palm side of glove G, the backside not being shown.

Figure 2:
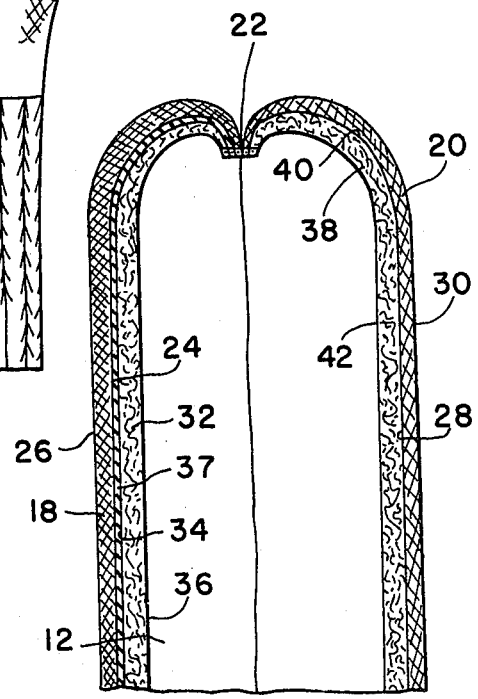
FIG. 2 is a fragmental sectional view, on an enlarged scale, taken on the lines 2—2 of FIG. 1.

Referring now to FIG. 2, it can be seen that glove G has a first shell section 18 which generally defines the palm side of glove G and a second shell section 20 which generally defines the backside of glove G. First and second shell sections 18 and 20 are adjoined to one another in a suitable manner, such as by sewing or stitching, to form a seam 22, seam 22 generally dividing glove G into the palm side half and the backside half. As will be recognized, first shell section 18 and second shell section 20 when secured to one another will provide an opening for insertion of a wearer's hand, the opening being generally defined by an adjoining seam 17 between the body of glove G and wristlet 16. First shell section 18 and second shell section 20 are both comprised of a fabric of a temperature-resistant aromatic polyamide fiber, a particularly desirable such fiber being manufactured by the DuPont Company and sold under the trademark "Kevlar."

First shell section 18, forming the palm side of glove G, has an inner surface 24 and an outer surface 26 and is preferably comprised of a tight, twill weave fabric of the polyamide fiber, the twill weave providing greater wear qualities than other forms of fabric construction and therefore being more desirable for the palm side of glove G. Preferably, inner surface 24 of first shell section 18 is napped, the napped surface enhancing the insulating ability of first shell section 18. Desirably, the twill weave fabric of first shell section 18 will have a weight per unit square area of about 8 oz./sq.yd. Second shell section 20, forming the backside of glove G, also has an inner surface 28 and an outer surface 30 but is preferably of knitted construction to provide stretch for improved dexterity and comfort to the wearer. It is preferred that the napped side of second shell section 20 also be on the inner surface 28 of second shell section 20. The knitted fabric forming second shell section 20 will preferably have a weight per unit square area of about 7 oz./sq.yd.

Secured to said first shell section inwardly thereof is a first liner section 32, liner section 32 having first and second surfaces 34 and 36, respectively. The first surface 34 of liner section 32 generally faces and overlies the inner surface 24 of first shell section 18. In the preferred case, first liner section 32 comprises a felt fabric of a temperature-resistant aromatic polyamide fiber, such as Kevlar. The felt fabric of liner section 32 provides both puncture resistance and thermal insulation. The first surface 34 of liner 32 has a flame-resistant elastomeric coating 37, coating 37, accordingly, being disposed between the inner surface 24 of first shell section 18 and the first surface 34 of first liner section 32. Generally speaking, the elastomeric coating will be from about 4 to about 5 mils in thickness. The elastomeric coating, while preferably a neoprene elastomer, can be any elastomeric material which has similar flexibility, and heat and flame-resistant properties as those of neoprene and which therefore aids in preventing conductive heat penetration through the palm side of the glove G.

Glove G is also provided with a second liner section 38 having first and second surfaces 40 and 42, respectively, the first surface 40 of second liner section 38 facing and generally overlying the inner surface 28 of second shell section 20. The second liner section 38 is, like first liner section 32, generally formed of a felt fabric of a temperature-resistant aromatic polyamide fiber such as Kevlar and will preferably have a weight per unit square area of about 3.5 oz./sq.yd.

It will be appreciated that first and second liner sections 32 and 38 will generally conform to and be secured to first and second shell sections 18 and 20, respectively, as well as to each other. This is conveniently done by sewing the shell sections and the liner sections together along their peripheral edges as at seams 17 and 22, preferably with a temperature-resistant thread such as a thread made from Kevlar fiber.

Although optional, it is preferable that glove G be provided with a wristlet 16 which, as will be recognized, will be generally tubular in configuration, one end of which will be attached to glove G at seam 17 in generally encircling relation to the opening in glove G for insertion of the wearer's hand. Wristlet 16 will preferably be made of a knitted fabric of a temperature-resistant aromatic polyamide fiber such as Kevlar. The knitted construction of the wristlet 16 provides somewhat of a flexible seal around the wrist of the wearer to minimize, to the extent possible, the ingress of water or other materials into the interior of glove G. Wristlet 16 will generally be about 4" in length although shorter or longer lengths may be used if desired for special purposes. For example, lengthening the wristlet 16 will provide better protection to the lower forearm of the wearer if wristlet 16 is made of a temperature-resistant fabric such as Kevlar.

It will be appreciated that the various weights of the fabrics used in the composite glove of the present invention can vary somewhat depending on the particular application for which the glove is designed. The weights of the various fabrics noted above appear to impart excellent properties to the gloves in terms of heat and flame resistance and resistance to cuts and punctures while still providing adequate dexterity and comfort for the wearer.

To demonstrate the utility of the gloves of the present invention, they were subjected to appropriate NIOSH test procedures. The results are shown in the table below.

TABLE

| NIOSH* Test | NIOSH Criteria | Performance Rating |
|---|---|---|
| Cut Resistance | No surface cut @ 16 lbs | Pass |
| Puncture Resistance | 13.2 lbs minimum | 23 lbs |
| Resistance to Conductive Heat Penetration | Not to exceed injury threshold temperature for 5 seconds | 4.6 sec |
| Resistance to Radiant Heat Penetration | Not to exceed injury threshold temperature for 10 minutes | ½–1 min |
| Resistance to Flame | After-flame <2 sec<br>After-glow <2 sec<br>Visible char <1 in | Pass |
| Dexterity | Pick up 0.20 in diameter × 1.6 in long steel pin between thumb and each finger | Pass |

*National Institute for Occupational Safety and Health

As the results in the table above show, the composite gloves of the present invention are ideally suited for use as fire fighters' gloves. It will also be recognized that the gloves are equally suited for uses by other workers such as foundry workers and the like whose hands are subjected to excessive temperatures and may come in contact with objects or work pieces than can puncture or cut the hand of the wearer.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

We claim:

1. A heat-resistant protective glove comprising:

a first shell section generally defining the palm side of said glove and having inner and outer surfaces, said first shell section comprising a twill weave fabric of a temperature-resistant aromatic polyamide fiber;

a second shell section generally defining the backside of said glove and having inner and outer surfaces, said second shell section comprising a knitted fabric of a temperature-resistant aromatic polyamide fiber, said first and second shell sections being secured to one another so as to provide an opening for insertion of a wearer's hand;

a first liner section secured to said first shell section and having first and second surfaces, said first surface of said first liner section facing and generally overlying said inner surface of said first shell section, said first liner section comprising a felt fabric of a temperature-resistant aromatic polyamide fiber having a flame resistant, elastomeric coating on said first liner surface; and a second liner section secured to said second shell section and having first and second surfaces, said first surface of said second liner section facing and generally overlying said inner surface of said second shell section, said second liner section comprising a felt fabric of a temperature-resistant aromatic polyamide fiber.

2. The glove of claim 1 wherein said aromatic polyamide fiber comprises Kevlar.

3. The glove of claim 1 wherein said elastomeric coating comprises neoprene.

4. The glove of claim 3 wherein said coating is in the range of from about 4 to about 5 mils in thickness.

5. The glove of claim 1 wherein said first and second shell sections are secured to one another using thread formed from a temperature-resistant aromatic polyamide fiber.

6. The glove of claim 1 further including a generally tubular wristlet having one end secured to said first and second shell sections and in generally encircling relation to said opening for insertion of said hand.

7. The glove of claim 1 wherein said inner surface of said first shell section is napped.

8. The glove of claim 1 wherein said inner surface of said second shell section is napped.

9. The glove of claim 1 wherein said twill weave fabric of said first shell section has a weight per unit square area of 8 oz./sq.yd.

10. The glove of claim 1 wherein said knitted fabric of said second shell section has a weight per unit square area of 7 oz./sq.yd.

11. The glove of claim 1 wherein said fabric of said first and second liner sections has a weight per unit square area of 3.5 oz./sq.yd.

* * * * *

UNITED STATES PATENT OFFICE

CERTIFICATE OF CORRECTION

Patent No. 4,433,439 Dated Feb. 28, 1984

Inventor(s) Richard P. Tschirch, Kenneth R. Sidman, Irving J. Arons

It is certified that error appears in the above-identified patent and that said Letters Patent are hereby corrected as shown below:

Cover page, block [73], delete "Richard P. Tschirch, Westwood" as an assignee.

Cover page, block [75], add "Richard P. Tschirch, Westwood" to list of co-inventors, Kenneth R. Sidman, Wayland; and Irving J. Arons, Peabody, all of Mass.

Signed and Sealed this

*Seventeenth* Day of *July 1984*

[SEAL]

*Attest:*

GERALD J. MOSSINGHOFF

*Attesting Officer*

*Commissioner of Patents and Trademarks*